US005222822A

United States Patent [19]

Hernandez

[11] Patent Number: 5,222,822

[45] Date of Patent: Jun. 29, 1993

[54] DISPENSING DEVICE FOR PARTICULATE MATERIAL

[76] Inventor: Javier Hernandez, Diagonal 85A No. 23-61, Apt. 402, Bogota D.C.,, Colombia

[21] Appl. No.: 816,391

[22] Filed: Dec. 27, 1991

[51] Int. Cl.[5] ..... A46B 11/02; B05B 11/06

[52] U.S. Cl. ..... 401/153; 222/210; 222/215; 222/633; 401/184; 401/288; 401/290

[58] Field of Search ..... 401/183, 184, 186, 153, 401/288, 290, 291; 239/327; 222/215, 209, 210, 632, 633

[56] References Cited

U.S. PATENT DOCUMENTS

| | | | |
|---|---|---|---|
| 668,357 | 2/1901 | Ritz | 401/288 |
| 1,083,071 | 12/1913 | Falkenstein | 401/290 |
| 2,716,836 | 9/1955 | Winkelstrater | 222/210 |
| 2,738,615 | 3/1956 | Childs et al. | 222/210 X |
| 2,825,080 | 3/1958 | Bongiovanni | 401/288 |
| 2,899,110 | 8/1959 | Parker | 222/215 |
| 3,395,836 | 8/1968 | Stahmer | 401/183 X |
| 3,409,182 | 11/1968 | McDonnell | 239/327 X |
| 3,411,674 | 11/1968 | Gould | 222/215 |
| 4,533,273 | 8/1985 | Obata et al. | 401/288 X |
| 4,723,691 | 2/1988 | Minkevitch et al. | 239/327 X |
| 4,944,625 | 7/1990 | Futter et al. | 401/153 |

FOREIGN PATENT DOCUMENTS

| | | | |
|---|---|---|---|
| 64727 | 11/1982 | European Pat. Off. | 222/215 |
| 1129135 | 1/1957 | France | 401/183 |
| 1207758 | 9/1959 | France | 401/183 |
| 1259584 | 3/1961 | France | 401/184 |
| 621769 | 6/1961 | Italy | 239/237 |
| 636824 | 10/1936 | Switzerland | 401/288 |
| 345868 | 6/1960 | Switzerland | 401/183 |

*Primary Examiner*—Steven A. Bratlie
*Attorney, Agent, or Firm*—Neil F. Markva

[57] ABSTRACT

A particulate material dispensing assembly comprises a container for storing particulate material and includes an end cap device having a passageway for discharging the particulate material. The end cap device is disposed at a discharge end of the container and includes a removably mounted brush. The container includes a base section, a delivery section and a collapsible resilient coupling section connecting the base section to the delivery section.

20 Claims, 4 Drawing Sheets

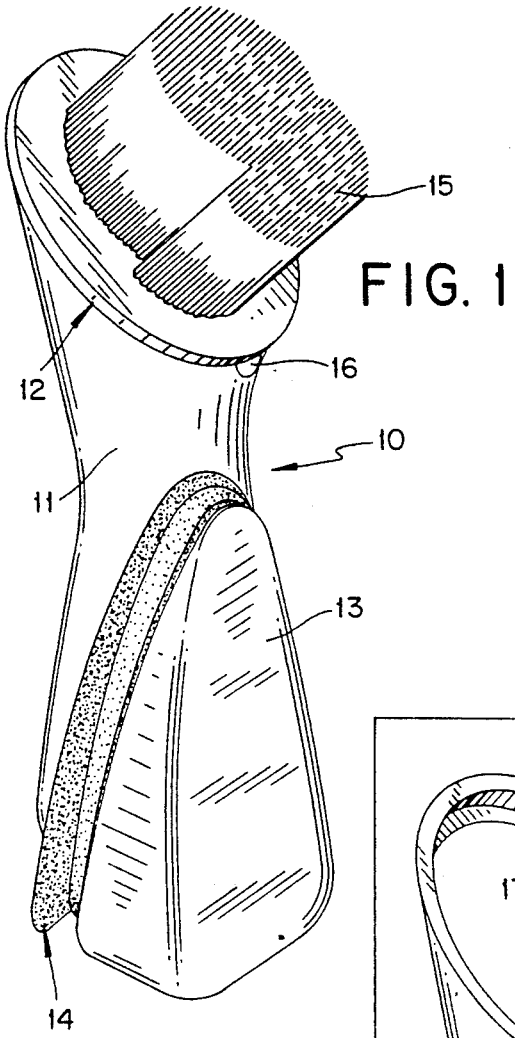
FIG. 1
FIG. 2
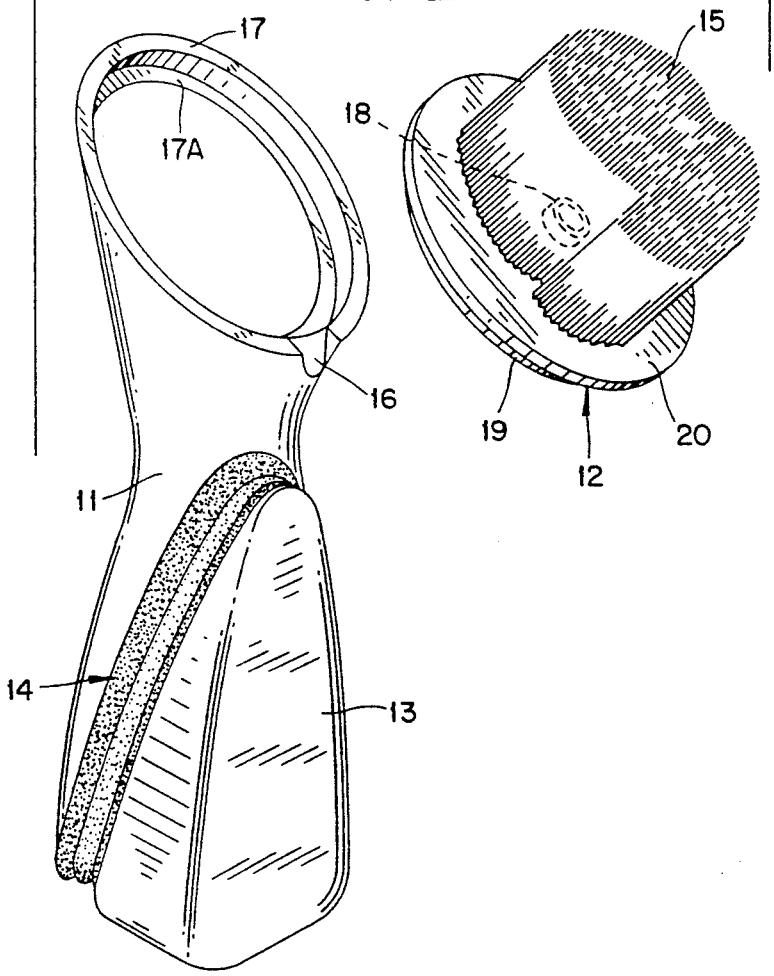

DISPENSING DEVICE FOR PARTICULATE MATERIAL

FIELD OF THE INVENTION

This invention relates to particulate material dispensing devices. More particularly, the invention is directed to dispensing devices for powder as used in hairdressing shops, beauty parlors and in private homes.

BACKGROUND OF THE INVENTION

Dispensing devices for particulate material such as fungicides, insecticides, dusting powders, cosmetic powder, deodorant and desiccant-type powders such as talcum powders are well known.

U.S. Pat. Nos. 1,912,385 and 1,936,879 disclose a dispensing container comprising two rectangular box-like sections joined by a bellows portion. Inside the box containers is a specially designed manifold operating in combination with the bellows portion to discharge powder from the containers through a discharge opening.

U.S. Pat. Nos. 2,491,118 and 2,738,615 disclose hand-operated dispensing devices having a flexible, tubular bellows portion interconnecting to rigid sections. By turning and twisting the rigid sections with respect to each other through the flexible bellows portion, pulverized particulate material is forced from an inner chamber of the housing or casing to project insecticide dust outwardly from a discharge tube opening.

U.S. Pat. Nos. 535,439; 2,551,676; 3,199,743; and 3,255,933 each disclose a type of dispensing container for discharging powdered materials. The patents '439 and '933 incorporate a bellows configuration in combination with rigid wall sections of container. Patents '676 and '743 disclose dispensing devices having a flexible material forming a portion of the container wall that may be manually squeezed or pushed to force particulate material through a container discharge opening.

U.S. Pat. Nos. 653,866; 2,223,076; 2,609,971; 2,718,987; 4,007,858; and 4,730,751 show the state of the art regarding dispensing powder materials from various container configurations. Each of these known structures has a manually flexible wall portion for dispensing powder through discharge openings.

With respect to a particular problem involving particulate dispensing devices, hairdressers, barbers and workers in associated trades have experienced difficulty in effectively applying and dispersing powder on a customer receiving their services such as, for example, after cutting the customer's hair.

When using a container of powder having dispensing openings at one end thereof, it is necessary to tilt the entire container to allow the powder to fall by gravity through the dispensing openings. Little or no control is possible when using such a prior art container. Consequently, considerable waste of the particulate product is experienced.

A further problem is associated with employing a brush device for spreading powder placed on the skin of a user. A brush permanently secured to a container is thereby used from one person to the next. Consequently, there is a danger of passing a contagious skin condition from one person to another.

None of the prior art dispensing containers may be pumped by placing in the palm of one hand. And, indeed, the known devices may require two hands to operate. Furthermore, none of the prior art devices disclose or suggest the particular composite structure of this invention.

PURPOSE OF THE INVENTION

The primary purpose of the invention is to provide a powder dispensing device that may be operated within the palm of a user's hand and overcome problems associated with prior art particulate dispensing devices.

Another object of the invention is to provide a device for dispensing particulate material having two rigid housing sections joined by a bellows portion requiring one hand of a user to operate.

A further object of the invention is to provide a particulate dispensing device having a removably mounted brush means for spreading powder discharged from the dispensing device so that a new brush means may be used for each application of powder from the dispensing device.

SUMMARY OF THE INVENTION

The invention is directed to a device for applying particulate material. The device comprises container means for storing particulate material and includes end cap means having passageway means for dispensing the stored particulate material. The container means includes a rigid base section, a rigid delivery section and a collapsible resilient coupling section connecting the base section to the delivery section. The end cap means is disposed at a discharge end of the container means and includes a removably mounted brush means.

In one embodiment, the container means consists essentially of a single unitary shell housing including the base section, delivery section and the coupling section. To produce the single unitary shell housing, the coupling section may be integrally molded to the base and delivery sections. The annular resilient coupling member is placed into a mold cavity and the rigid base and delivery sections are injection molded directly to the coupling member.

In another embodiment, the container means comprises a shell housing including outer shell sections contiguously disposed over an outer surface of an inner liner receptacle means. An outer base shell section is disposed around an outer surface of an inner receptacle base section and an outer delivery shell section is disposed around an outer surface of an inner receptacle delivery section. In this embodiment, the inner receptacle is first molded as a single continuous housing having a base section, coupling section and a delivery section. The inner receptacle is made of the same resilient material throughout with rigid material being used to form the outer shell sections.

A feature of the invention is directed to the coupling section which includes an annular resilient coupling member having end face coupling surfaces. The rigid base section has a coupling surface frictionally connected to one of the end face coupling surfaces of the resilient coupling member and the rigid delivery section has a coupling surface frictionally connected to the other end face coupling surface of the resilient coupling member.

Another feature of the invention is directed to an end cap assembly including a lid base member and a brush fixture member that removably mounts brush means to the lid base member. In a specific embodiment, the end cap assembly includes a conically-shaped passageway that extends through both the lid base member and the brush fixture member.

In another specific embodiment, the lid base member includes a recess having a shaped inner peripheral edge surface. A brush securing member has an outer peripheral edge surface having a structural configuration effective to slidably fit into the shaped inner peripheral edge surface of the recess for holding a brush means which extends outwardly from the end cap means.

Another feature of the assembly is directed to a brush securing member. A projection means extends outwardly from an outer lateral surface by an amount effective to be grasped by the fingers of a user to insert and remove the brush securing member into and out of the recess of the lid base member. The projection means includes an aperture registered with an open passageway defined by a first conical surface in the lid base member. The registered aperture is defined by a second conical surface coextensive with the first conical surface to from a passageway having a continuous conical surface.

A further feature of the invention is directed to the brush means. A securing portion is disposed between the shaped inner and outer peripheral edge surfaces on the respective recess and brush securing member to removably fix the brush means to the lid base member. When particulate material is dispensed through the discharge passageway means, the brush means may be used to distribute the dispensed particulate material. In a particular embodiment, each of the shaped inner and outer peripheral edge surfaces includes a striated surface configuration to fasten therebetween the continuous securing brush edge portion in a zigzag path.

In another embodiment, the end cap assembly includes a brush fixing member having a plurality of holes through which brush bristles project outwardly from a first side of the fixing member. Securing means fix the brush bristles to the other side of the fixing member. An adhesive material may be used to secure the brush bristles in place.

Another embodiment of the invention is directed to a container means having a dispensing end cap assembly and defining a chamber in which particulate material may be disposed for storage. The container means has a longitudinal axis, a housing wall and an elastically recoverable bellows portion peripherally located along the housing wall and disposed at an angle other than normal to the longitudinal axis. The dispensing end cap assembly includes passageway means through which particulate materials is dispensed when exerting manual pressure to cause the bellows portion to collapse by hand pumping within the user's fist.

In this embodiment, the dispensing end cap assembly includes an end cap member removably mounted to the container means. The removable end cap member includes brush means composed of a disposable material so that it may be thrown away after a single use.

A further feature of the invention is directed to an end cap member removably mounted to a container having an outer end opening defined by an annular end wall and shoulder means projecting outwardly from the container end wall. More specifically, the container end wall includes an outer end abutment surface and a shoulder projects from the annular end wall toward the longitudinal axis of the container. The end cap member has an annular wall member that slidingly pressure fits against and forms as air seal along the annular container end wall structure. Thus, the inserted end cap member precludes the discharge of particulate material from between the fitted wall structures.

A further feature of the novel container includes a shell housing having a delivery shell section, a base shell section and a bellows portion. The bellows portion includes an annular coupling member connected at one side thereof to the delivery shell section and at the other side thereof to the base shell section. The brush means is removably mounted to the discharge end of the delivery shell section.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a perspective view of a dispensing device made in accordance with the invention;

FIG. 2 is a perspective view of the dispensing device of FIG. 1 having the end cap assembly shown in an exploded view;

DETAILED DESCRIPTION

Figure 3:
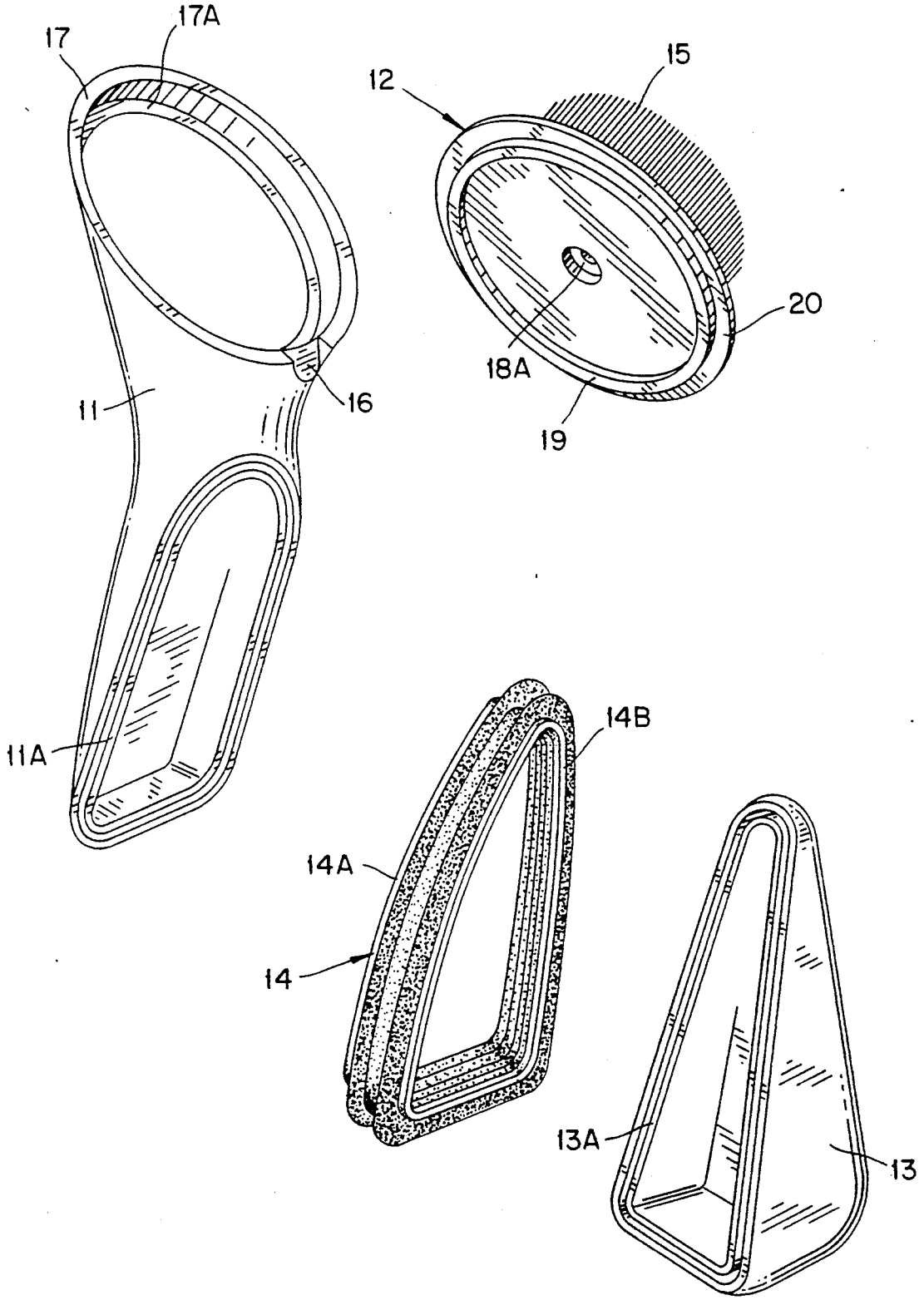
FIG. 3 is an exploded perspective view of the dispensing device of FIG. 1.

The dispensing device, generally designated 10, comprises a rigid delivery section 11 and a rigid base section 13 joined by a collapsible resilient coupling section 14 having parallel outer end surfaces as shown.

In this embodiment, coupling section 14 has an annular flange 14A on one end surface and a second annular flange 14B on the other end surface. The coupling section is composed of an elastic or resilient material that is collapsible when pushed together along its end surfaces. The resilient material may be plastic, natural or synthetic rubber which can be deformed under pressure of a user's fist and will resume its original shape when pressure is released.

The first rigid shell section 11 comprises a delivery section of device 10 and has a concave form ending in its upper edge in a bell-shaped mouth having a substantially oval-shaped opening. End cap assembly 12 includes cover member 20 removably mounted to the bell-shaped mouth of delivery section 11. The outer end opening of delivery section 11 is defined by a annular container end wall 17 and shoulder 17A projecting outwardly therefrom. Cover member 20 has an annular wall member 19 that slidingly pressure fits against the abutment end and side of container end wall 17 to preclude the discharge of particulate material therebetween when in place.

A grooved notch 16 is located in container end wall 17 to remove end cap assembly 12 when necessary to replenish the powder supply inside container 10. Grooved notch 16 receives either a pointed instrument or the fingernail of the user to pry the pressure fit assembly 12 from the bell-shaped mouth of delivery section 11.

The lower end surface of delivery section 11 includes a circumferential groove 11A which receives the annular projecting flange 14A of coupling section 14. Likewise, base section 13 has a circumferential groove 13A on its outer end surface to receive the annular projecting flange 14B of coupling section 14.

The circumferential grooves 11A and 13A are slightly bevelled to frictionally connect the annular flange projections 14A and 14B to the respective container delivery section 11 and container base section 13. Thus, a single unitary container is formed for storing powder material to be dispensed as desired.

In another embodiment of the invention, coupling section 14 may be positioned in a mold cavity into which plastic material is injected to form rigid plastic sections 11 and 13 integrally bonded to the end surfaces of coupling section 14. Such a coupling section 14 would have appropriate end surface configurations to insure an integral bonding of the injection molding material to each of its respective end surfaces.

When rigid delivery section 11 and base section 12 are injected molded to respective parallel end faces of coupling section 14, the injection molded material would produce a single unitary housing wall incorporating the coupling section.

Figure 10:
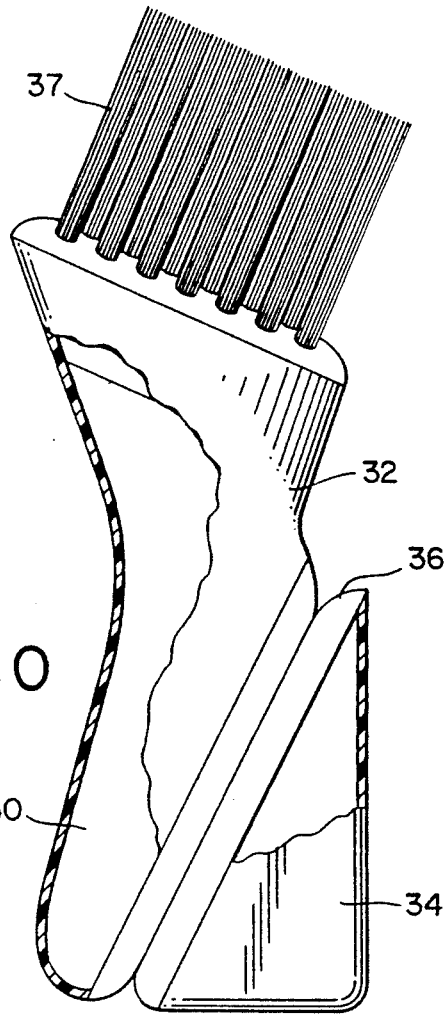
FIG. 10 is a fragmentary elevational view of another embodiment of a dispensing device according to the invention.

In the embodiment of FIG. 10, resilient plastic material may be molded to form a liner receptacle 30 having collapsible and recoverable characteristics throughout its structure. Outer rigid shell sections 32 and 34 are shaped to fit over the receptacle portions formed on either side of a collapsible bellows section 36 as shown.

Any person having ordinary skill in the art of injection molding could readily develop the necessary mold cavity and compositional requirements to effect either of the molded plastic embodiments as described above.

Container 10 of FIGS. 1–4 has a dispensing end cap assembly 12 and defines a chamber in which particulate material may be disposed for storage. Container 10 has a longitudinal axis, a housing wall formed by the shell sections 11 and 13 and coupling section 14. In this embodiment, coupling section 14 is an elastically recoverable bellows peripherally located around the housing wall and disposed at an angle other than normal to the longitudinal axis as shown. Coupling section 14 is disposed at an angle of about 30° from the longitudinal axis of container 10.

Dispensing end cap assembly 12 includes a passageway 18 adapted to allow particulate material stored in the chamber of container 10 to be dispensed therethrough. By exerting manual pressure from opposing directions onto rigid delivery section 11 and base section 13, bellows coupling section 14 collapses under the action of hand pumping within the user's fist. Pumping produces a pressure forcing the powder outwardly through passageway 18.

Figure 4:
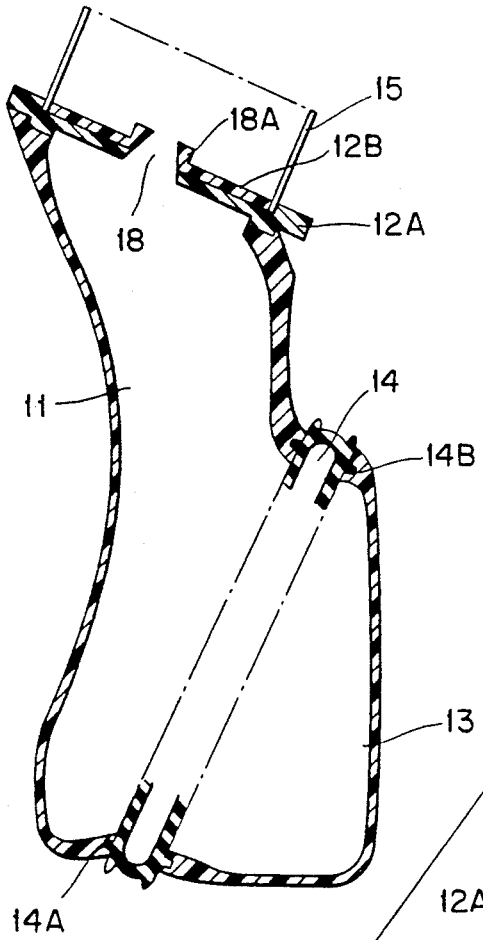
FIG. 4 is a longitudinal sectional view of the dispensing device of FIG. 1.

In this specific embodiment, passageway 18 is conically shaped as shown in FIG. 4. End cap assembly 12 includes a lid base member 12A having a first conical surface to form the lower portion of passageway 18. Brush securing member 12B includes a projection 18A having an opening formed by a second conical surface coextensive with the first conical surface of lid base member 12A.

Projection 18A extends outwardly from the outer lateral surface of securing member 12B by an amount effective to be grasped by the fingers of a user to insert and remove securing member 12B into and out of a recess 12C in lid base member 12A.

Figure 9:
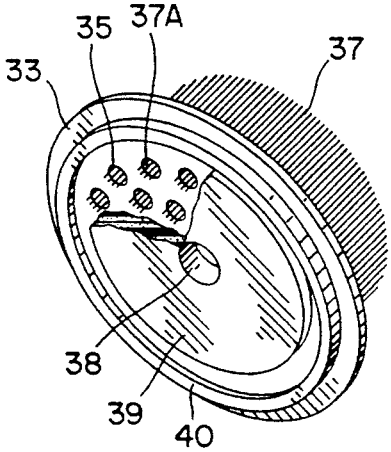
FIG. 9 is a fragmentary perspective view of a removable brush means made in accordance with the invention.

In another embodiment shown in FIG. 9, a single lid cover member 33 having an annular wall 31 shaped to slidingly fit within annular end wall 17. Thus, lid cover member 33 is removably mounted to container 10. Cover member 33 has a plurality of holes 35 through which bristles 37 project outwardly from a first side of cover member 33. Securing means 39 such as an adhesive material fixes brush bristles 37A to the other side of cover member 33. At least one opening 38 extends through cover member 33 to dispense powder therethrough.

As shown, the oval-shaped mouth opening of container 10 is located within a plane that is disposed at an angle other than normal to the longitudinal axis of container 10. As is evident in the drawings of this embodiment, the plane is disposed at about 60° from the horizontal and about 30° from the longitudinal axis of container 10. This structural configuration together with the bellows configuration enables the user to hold the container substantially upright in one hand while dispensing powder through passageway 18.

Once powder is discharged onto the individual being served by the user, brush 15 is then used to eliminate any cut hair particles from the surface of the individual's skin. The purpose of dispersing talcum powder onto the skin of a person having a haircut is to dry the skin's surface from which small pieces of cut hair may be removed through the sweeping action of brush 15.

Figure 5:
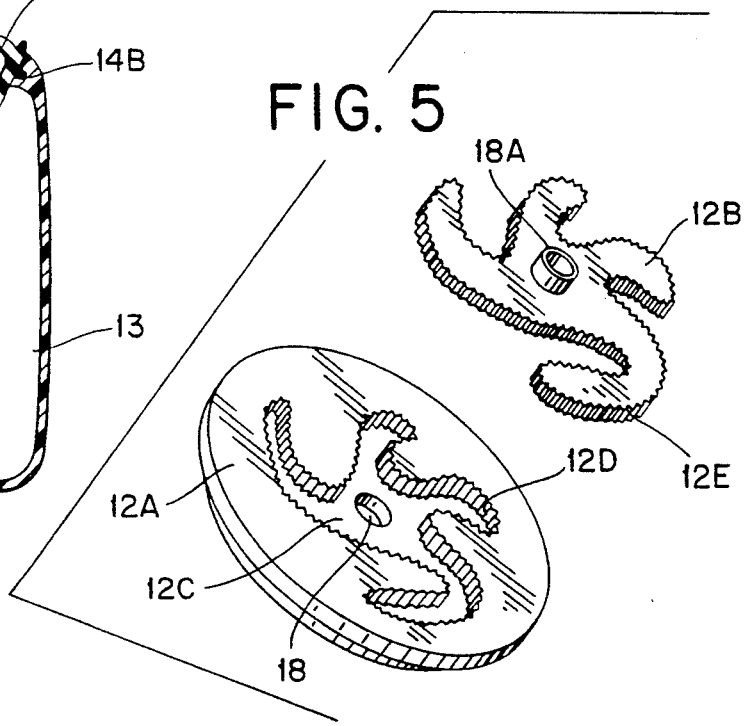
FIG. 5 is an exploded view of a particular embodiment of an end cap assembly according to the invention.

The end cap assembly 12 shown in FIG. 5 includes a lid base member 12A and brush means 15 removably mounted to member 12A. A brush fixture member 12B includes a conically-shaped passageway 18 and projection 18A. Brush fixture member 12B removably secures brush means 15 to the end cap assembly 12.

Lid base member 12A includes a recess 12C having a shaped inner peripheral edge surface 12D. Brush securing member 12B has an outer peripheral edge surface 12E having a structural configuration effective to slidably fit into the shaped inner peripheral edge surface 12D of recess 12C for holding brush means 15 to project outwardly from end cap assembly 12.

The shaped peripheral edge surfaces 12D and 12E include a striated surface configuration to fasten a continuous securing edge portion of brush means 15 in a zig-zag path therebetween. As shown, a single brush path surrounds the shaped securing member 12B. It has been found that the more sinuous the shape of securing member 12B, the tighter and more efficient will be brush 15 for brushing powder discharged from container 10.

Brush securing member 12B has an outer lateral surface from which projection 18A extends outwardly by a amount effective to be grasped by the fingers of a user to insert and remove securing member 12B into an out of recess 12C.

Projection 18A includes an aperture registered with open passageway 18 defined by a first conical surface in lid base member 12A. The registered aperture of projection 18A is defined by a second conical surface coextensive with the first conical surface of lid base member passageway 18 thereby forming a single conically shaped passageway.

Figure 6A:
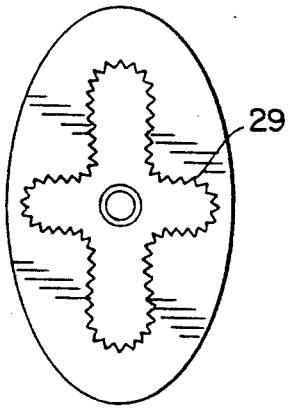
FIGS. 6*a* and 6*b* are plan views of shaped recesses in a respective lid cover member made in accordance with this invention.
Figure 6B:
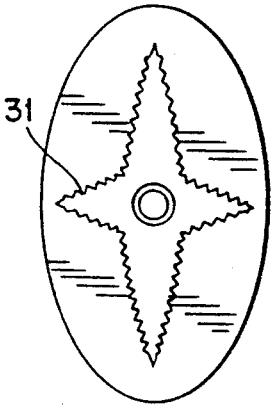

Brush securing member 12B has an outer profile similar to a starfish. FIGS. 6*a* and 6*b* show recesses 29 and 31 having a rounded cross configuration and a pointed cross configuration, respectively, as shown.

Figure 7:
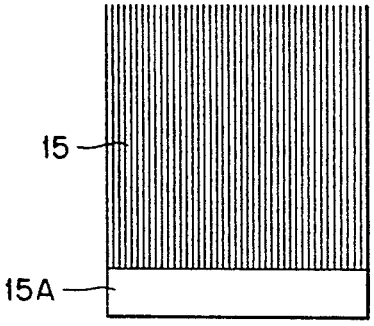
FIG. 7 is an elevational view of a brush having a flat band securing portion.
Figure 8:
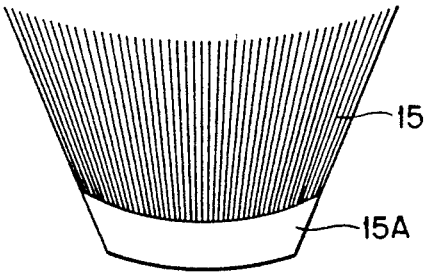
FIG. 8 discloses another form of the embodiment of a flat band securing portion as shown in FIG. 7.

In FIGS. 7 and 8, brush 15 has a securing edge portion 15A designed to fit between the corresponding striated edge surfaces 12D and 12E as discussed above. Brush 15 is composed of a band of paper or similar material having a continuous edge portion on one edge thereof. Paper, cardboard, or bristol board-type material ma be used to produce brush 15 having the continuous securing edge portion 15A disposed along one side thereof.

The opposite side of the band has been cut into strips forming a plurality of independent vertical projections from the edge portion shown in FIGS. 7 and 8. The strips form constitute bristles 15 having sufficient rigidity to spread the talcum powder and sweep the particles of hair away from the customer's skin surface.

Brush 15 in FIG. 8 is shown with its securing strip 15A rounded thereby conforming brush 15 to a particular configuration of a securing member. After being used once, brush 15 may be appropriately removed and thrown away by manipulation of brush fixing member 12B with respect to lid cover member 12A described.

While the particulate material dispensing device has been shown and described in detail, it is obvious that this invention is not to be considered limited to the exact form disclosed, and that changes in detail and construction may be made therein within the scope of the invention without departing from the spirit thereof.

Having thus set forth and disclosed the nature of this invention, what is claimed is:

1. An assembly for applying particulate material, said assembly comprising:

a) a container defining a chamber for storing particulate material and including end cap means having passageway means for dispensing the particulate material, b) the end cap means being disposed at a discharge end of the container, c) said end cap means including a removably mounted brush means, d) said container including a rigid base section, a rigid delivery section and a collapsible resilient coupling section connecting the base section to the delivery section to form an outer surface structural configuration effective to fit into a single hand of the user whereby particulate material may be expelled through the passageway means by collapsing the coupling section when single hand pumping the two rigid portions inwardly toward the coupling section, e) said coupling section including an annular resilient coupling member having end face coupling surfaces, f) said base section having a coupling surface frictionally connected to one of the end face coupling surfaces of the resilient coupling member, and g) said delivery section having a coupling surface frictionally connected to the other end face coupling surface of the resilient coupling member.

2. An assembly as defined in claim 1 wherein the end cap means includes a lid base member and separate brush means removable mounted to the lid base member.

3. An assembly as defined in claim 1 wherein the end cap means includes a brush fixture member and separate brush means, the end cap means includes a conically-shaped passageway extending completely through the end cap means, and the brush fixture member removable secures the brush means to the end cap means.

4. An assembly as defined in claim 1 wherein the end cap means includes a lid base member, brush means and a brush securing member, the lid base member includes a recess having a shaped inner peripheral edge surface, and the brush securing member has an outer peripheral edge surface having a structural configuration effective to slidably fit into the shaped inner peripheral edge surface of the recess for holding a brush means which is disposed between said inner peripheral edge surface and outer peripheral edge surface and extends outwardly from the end cap means.

5. An assembly as defined in claim 4 wherein the brush securing member has an outer lateral surface and includes projection means extending outwardly from the outer lateral surface by an amount effective to be grasped by the fingers of a user to insert and remove the brush securing member into and out of the recess of the lid base member.

6. An assembly as defined in claim 5 wherein the projection means includes an aperture registered with an open passageway defined by a first conical surface in the lid base member, and the registered aperture is defined by a second conical surface coextensive with the first conical surface of the lid base member passageway.

7. An assembly as defined in claim 4 wherein the brush means includes a securing portion disposed between the shaped inner and outer peripheral edge surfaces to removably fix the brush means to the lid base member for brushing particulate material dispensed through the conically-shaped passageway upon pressing together the base section and delivery section to cause the coupling section to collapse thereby discharging particulate material from the container.

8. An assembly as defined in claim 7 wherein the shaped inner and outer peripheral edge surfaces each includes a striated surface configuration to fasten a continuous securing edge portion of the brush means in a zigzag path between the two peripheral edge surfaces.

9. An assembly as defined in claim 1 wherein the end cap means includes a brush fixing member having a plurality of holes through which brush bristles project outwardly from a first side of the fixing member and securing means fix the brush bristles to the other side of the fixing member.

10. A dispensing device for particulate material, said device comprising:

a) a container having a dispensing end cap means and defining a chamber in which particulate material may be disposed for storage, b) said container having a single longitudinal axis, a shell housing wall having an outer surface structural configuration formed along two shell housing sections secured on opposite sides of an elastically recoverable bellows portion, said outer surface structural configuration being effective to fit in a single fist of the user and the elastically recoverable bellows portion is peripherally located along the housing wall and in a plane that is disposed at an angle other than normal to the longitudinal axis, c) said dispensing end cap means including passageway means adapted to allow particulate material stored in said chamber to be dispensed therethrough when exerting manual pressure to cause the bellows portion to collapse by an action of a single hand pumping within the user's fist.

11. A device as defined in claim 10 wherein the dispensing end cap means includes an end cap member removably mounted to the container.

12. A device as defined in claim 11 wherein the removable end cap member includes removably mounted brush means composed of a disposable material.

13. A device as defined in claim 10 wherein the end cap means includes brush means and an end cap cover means connected to the container, said brush means being detachably mounted to the end cap cover means.

14. A device as defined in claim 13 wherein the end cap cover means includes an end cap member, the container has an outer end opening defined by an annular container end wall and shoulder means projecting outwardly from the container end wall, the end cap member has an annular wall member that slidingly pressure fits against the container end wall and is thereby effective to preclude the discharge of particulate material therebetween upon pumping the bellows portion.

15. A device as defined in claim 14 wherein the container end wall includes an outer end abutment surface and an annular shoulder projects toward the longitudinal axis of the container, said outer end abutment surface is located in a plane disposed at an angle other than normal to the longitudinal axis.

16. A device as defined in claim 10 wherein the container shell housing wall is defined by a rigid shell housing having a rigid delivery shell section and a rigid base shell section, and the bellows portion includes an annular collapsible coupling member connected at one side thereof to the rigid delivery shell section and at the other side thereof to the rigid base shell section.

17. A device as defined in claim 16 wherein the end cap means includes brush means having a securing portion for removably mounting the brush means to the container.

18. A device as defined in claim 10 wherein the plane of the bellows portion is disposed at an angle of about 60° from the horizontal and about 30° from the longitudinal axis.

19. An assembly for applying particulate material, said assembly comprising:

a) a container defining a chamber for storing particulate powder material and including two rigid cooperating sections joined together by a third resilient deformable annular section, b) said rigid and resilient sections defining an outer shell housing having an outer shell surface structural configuration effective to fit in a single hand of the user, said container including an upper lid having an opening whereby the powder may be expelled through said opening by exerting manual pressure along the outer shell surface with the user's single hand to push the two rigid cooperating sections toward the resilient section which partially collapses when performing an action of single hand pumping of the container to expel the powder by the pressure applied within the user's fist, c) end upper cap means being disposed at a discharge end of the container and including a container lid having an upper face, d) said upper end cap means including fastening means removably mounting separate brush means composed of disposable material, e) said separate brush means being removably secured on the upper face of the container lid to allow fast replacement of a used brush means with another brush means.

20. An assembly as defined in claim 19 wherein the container consists essentially of a three piece shell housing including said two rigid sections joined together by said resilient section to form said outer shell surface having an outer periphery, said resilient section extending along the entire outer periphery of the outer shell surface.

* * * * *